US009812789B2

(12) United States Patent
Lee et al.

(10) Patent No.: US 9,812,789 B2
(45) Date of Patent: Nov. 7, 2017

(54) ARRAY ANTENNA APPARATUS FOR IMPLEMENTING PREDETERMINED BEAM WIDTH USING PREDETERMINED NUMBER OF ANTENNA ELEMENTS

(71) Applicants: Samsung Electronics Co., Ltd., Gyeonggi-do (KR); Korea Advanced Institute of Science and Technology, Daejeon (KR)

(72) Inventors: Won-Seok Lee, Daejeon (KR); Seung-Tae Khang, Daejeon (KR); Yong-Hoon Kim, Gyeonggi-do (KR); Kyoung-Sub Oh, Daejeon (KR); Jong-Won Yu, Daejeon (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 14/916,990

(22) PCT Filed: Sep. 3, 2014

(86) PCT No.: PCT/KR2014/008265

§ 371 (c)(1),
(2) Date: Mar. 4, 2016

(87) PCT Pub. No.: WO2015/034258

PCT Pub. Date: Mar. 12, 2015

(65) Prior Publication Data

US 2016/0218440 A1 Jul. 28, 2016

(30) Foreign Application Priority Data

Sep. 4, 2013 (KR) ..... 10-2013-0105950

(51) Int. Cl.
*H01Q 21/20* (2006.01)
*H01Q 21/06* (2006.01)

(52) U.S. Cl.
CPC ..... *H01Q 21/20* (2013.01); *H01Q 21/061* (2013.01)

(58) Field of Classification Search
CPC ..... H01Q 21/20
(Continued)

(56) References Cited

U.S. PATENT DOCUMENTS 6,768,475 B2 7/2004 Ohtsuka et al.
2003/0090433 A1 * 5/2003 Ohtsuka ..... H01Q 3/26 343/867
2003/0142035 A1 7/2003 Goldstein

FOREIGN PATENT DOCUMENTS

JP H 07-288417 A 10/1995
JP 2003-264419 A 9/2003
(Continued)

OTHER PUBLICATIONS

Brockett, et al., "Subarray Design Diagnostics for the Suppression of Undesirable Greating Lobes", IEEE Trans. on Attennas & Propagation; vol. 60, No. 3, Mar. 2012; pp 1373-1380.
(Continued)

*Primary Examiner* — Dameon E Levi
*Assistant Examiner* — Andrea Lindgren Baltzell

(57) ABSTRACT

The present invention relates to an array antenna apparatus, comprising: a first antenna element arranged in the center of the outermost concentric circle having a radius determined according to the beam width of a beam to transmit; and antenna element sets arranged on the circumference of each of concentric circles arranged to have a predetermined interval within the outermost concentric circle, wherein each of the antenna element sets comprises an odd number of second antenna elements, and only one antenna element exists on a straight line corresponding to the radius.

9 Claims, 18 Drawing Sheets

(58) Field of Classification Search
USPC ..... 343/844
See application file for complete search history.

(56) References Cited

FOREIGN PATENT DOCUMENTS

| | | |
|---|---|---|
| JP | 2007-243352 A | 9/2007 |
| JP | 2012-127747 A | 7/2012 |

OTHER PUBLICATIONS

International Search Report dated Dec. 10, 2014 in connection with International Application No. PCT/LR2014/008265; 5 pages.
Written Opinion of the International Searching Authority dated Dec. 10, 2014 in connection with International Application No. PCT/LR2014/008265; 3 pages.

* cited by examiner

ARRAY ANTENNA APPARATUS FOR IMPLEMENTING PREDETERMINED BEAM WIDTH USING PREDETERMINED NUMBER OF ANTENNA ELEMENTS

CROSS-REFERENCE TO RELATED APPLICATIONS AND CLAIM OF PRIORITY

The present application claims priority under 35 U.S.C. §365 to International Patent Application No. PCT/KR2014/008265 filed Sep. 3, 2014, entitled "ARRAY ANTENNA APPARATUS FOR IMPLEMENTING PREDETERMINED BEAM WIDTH USING PREDETERMINED NUMBER OF ANTENNA ELEMENTS", and, through International Patent Application No. PCT/KR2014/008265, to Korean Patent Application No. 10-2013-0105950 filed Sep. 4, 2013, each of which are incorporated herein by reference into the present disclosure as if fully set forth herein.

DETAILED DESCRIPTION OF THE INVENTION

Technical Field

The present invention relates to an array antenna apparatus for implementing a predetermined beam width using a predetermined number of antenna elements.

Background Art

In general, an array antenna is used to enhance the directivity of an antenna. The array antenna has a structure in which a plurality of antenna elements are arranged, and adjusts a phase for each antenna element to steer a beam in a specific direction. The beam width of the array antenna is decided according to the size of the array antenna. In order to maintain a constant beam width, it is necessary to maintain the size of the array antenna by increasing the number of the antenna elements constituting the array antenna or widening the intervals between the antenna elements. However, if the antenna elements are arranged at intervals of a predetermined length (generally, $\lambda/2$) or more, grating lobes or undesired side lobes may be generated upon beam steering. Also, increasing the number of the antenna elements constituting the array antenna may increase system complexity, and also require additional Radio Frequency (RF) chains, for example, phase shifters, amplifiers, etc., which leads to an increase of manufacturing costs.

DISCLOSURE

Technical Problem

An aspect of the present invention provides a structure of an array antenna apparatus for implementing a predetermined beam width using a predetermined number of antenna elements while minimizing undesired lobes.

Technical Solution

In accordance with an aspect of exemplary embodiments of the present invention, there is provided an array antenna apparatus including: a first antenna element positioned at the center of an outermost concentric circle having a radius decided according to a beam width of a beam to be transmitted; and a plurality of antenna element sets respectively arranged on circumferences of a plurality of concentric circles arranged with a predetermined interval in the inside of the outermost concentric circle, wherein each of the antenna element sets includes an odd number of second antenna elements, and one antenna element exists on a straight line corresponding to the radius.

Advantageous Effects

According to the present disclosure, by designing an array antenna for implementing a predetermined beam width using a predetermined number of antenna elements, it is possible to design an array antenna according to a given beam width and a given number of antenna elements while minimizing the generation of undesired lobes. Accordingly, an optimal array antenna can be designed by freely selecting the number of antenna elements.

BEST MODE

Figure 1:
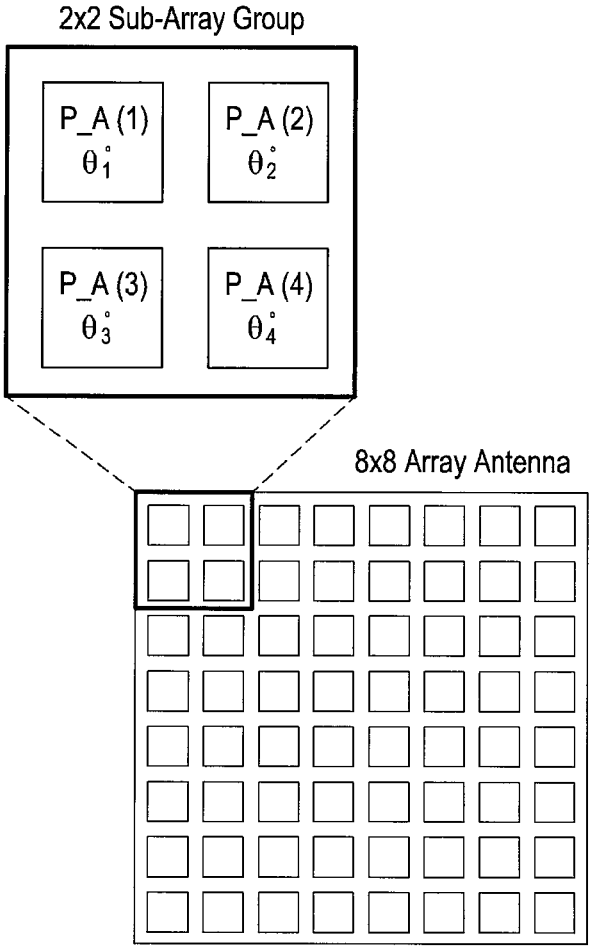
FIG. 1 shows an example of a structure of a sub-array antenna to which a method of using a general sub-array structure is applied.

Now, the operation principle of preferred embodiments of the present disclosure will be described in detail with reference to the accompanying drawings. Throughout the drawings, like reference numerals will be understood to refer to like components. In the following description of the present disclosure, a detailed description of known functions and configurations incorporated herein will be omitted when it may obscure the subject matter of the present disclosure. Also, terms used in the present disclosure are terms defined in consideration of the functions in the present disclosure; however, they may be changed according to a user's or operator's intention, the practice, or the like. Hence, the terms must be defined based on the contents of the entire specification, not by simply stating the terms themselves.

Generally, as methods for removing undesired lobes generated upon beam steering, there are a method of using a sub-array structure and a method of using an arrangement of a circular array antenna.

First, in the method of using the sub-array structure, an array antenna is configured by grouping a plurality of antenna elements using a Radio Frequency (RF) chain into one group. The method may increase the intervals between the antenna elements so that a grating lobe generated in a total array factor matches with the null position of an array factor of the corresponding sub-array group. Thereby, the method can suppress a grating lobe of a final array factor that is decided by a product of two factors, that is, a total array factor and an array factor for each sub-array group. The method of using the sub-array structure can suppress grating lobes while maintaining the number of RF chains and the intervals between antenna elements.

FIG. 1 shows an example of a structure of a sub-array antenna to which a method of using a general sub-array structure is applied.

Referring to FIG. 1, an array antenna may be configured by arranging 8 antenna elements on the horizontal axis and 8 antenna elements on the vertical axis, respectively. Also, the array antenna may be configured with a plurality of sub-array groups each of which is configured by grouping 2 antenna elements on the horizontal axis and 2 antenna elements on the vertical axis.

When beam steering is performed in the sub-array antenna to which the sub-array structure as described above is applied, the phase of the corresponding antenna element may be adjusted by a phase shifter. At this time, a total array factor moves to correspond to the angle of the steered beam, while an array factor for each sub-array group is not subject to such a change. Accordingly, a grating lobe, which is nulled by a product of the two factors when no beam steering is performed, moves by the beam steering so as to be not nulled. In order to overcome the problem, an array factor of each sub-array group may also need to move according to an angle of beam steering in correspondence to a total antenna factor. For this operation, a phase shifter may need to be added for each of antenna elements constituting each sub-array group, which leads to an increase of RF chains.

Meanwhile, the method of using the arrangement of the circular array antenna is to decide an arrangement of a circular array antenna in correspondence to a condition that no side lobe is generated due to a radiation characteristic. In the method, the number $M_n$ of antenna elements located on a n-th concentric circle may be decided according to the radius $a_n$ of the n-th concentric circle and a maximum steering angle $\theta_0$ satisfying, for example, Equation (1) below.

$$M_n+0.8\times M_n^{1/3}>k\times a_n(1+\sin\theta_0) \quad (1)$$

That is, the method of deciding the arrangement of the circular array antenna can decide a range in which no undesired side lobes will be generated, using a maximum steering angle and a beam width.

Figure 2:
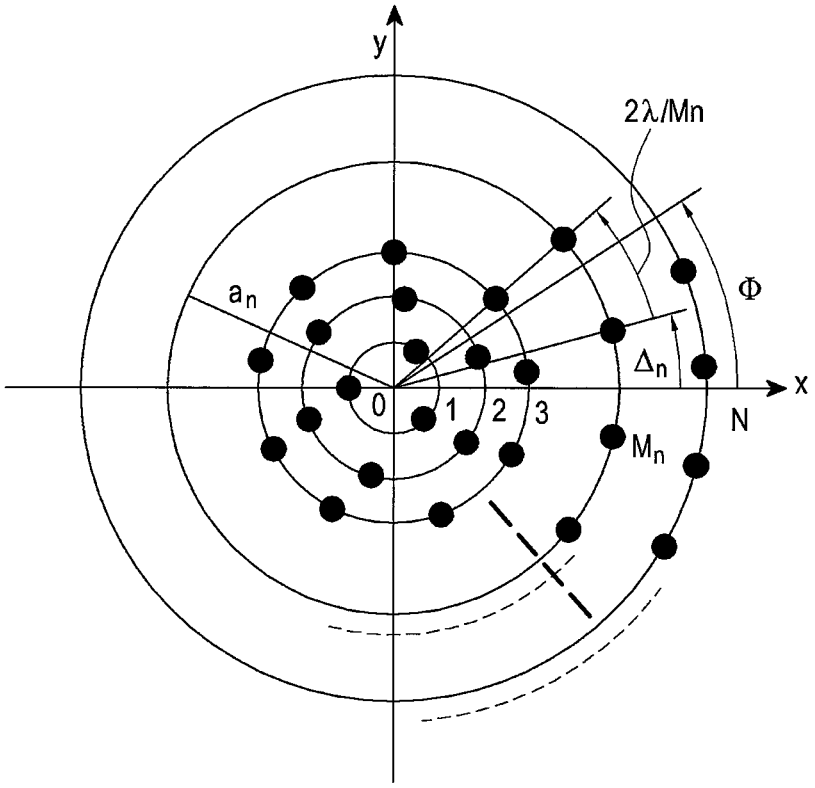
FIG. 2 shows an example of a circular array antenna to which a method of deciding an arrangement of a general circular array antenna is applied.

FIG. 2 shows an example of a circular array antenna to which a method of deciding an arrangement of a general circular array antenna is applied.

Referring to FIG. 2, 5 concentric circles may exist, and a plurality of antenna elements arranged on the respective concentric circles may be represented as "●". More specifically, in the method of deciding the arrangement of the circular array antenna, if the number of concentric circles increases in order to satisfy Equation (1), the number of antenna elements to be arranged on each concentric circle may also increase. In this case, the number of antenna elements to be arranged on each concentric circle with respect to the number of antenna elements arranged on the innermost concentric circle may increase by a multiple of the number of the concentric circles. Therefore, the number of antenna elements constituting the entire array antenna may increase exponentially. Then, the number of RF chains may also increase for each antenna element. Accordingly, the size and manufacturing cost of the array antenna may increase. Therefore, applying the method of deciding the arrangement of the circular array antenna to an array antenna for terminal that has limitations on a spatial degree of freedom and manufacturing costs may cause a problem of low utilization.

Therefore, according to an embodiment of the present disclosure, a structure of an array antenna which is capable of minimizing undesired lobes while implementing a predetermined beam width using a predetermined number of antenna elements is suggested. The array antenna according to the embodiment of the present disclosure may be applied to, for example, a Beam Division Multiple Access (BDMA) system for increasing channel capacity using beam adjustment to help design an effective beam steering array antenna. However, the present disclosure is not restrictively applied to the BDMA system, and can be applied to most of systems in which an array antenna can be installed.

Figure 3:
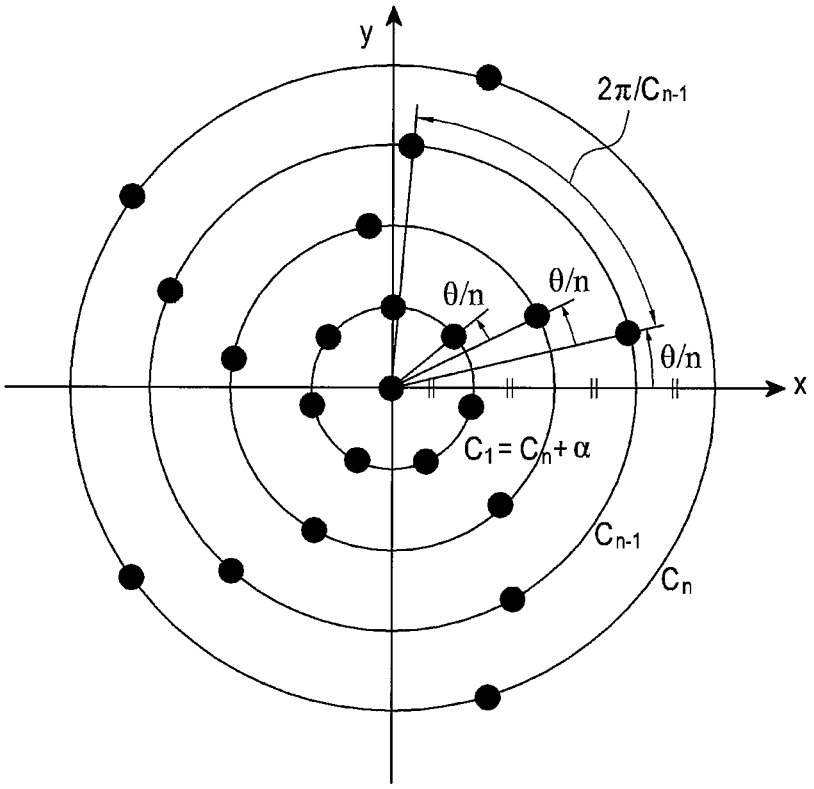
FIG. 3 shows an example of a structure of an array antenna according to an embodiment of the present disclosure.

FIG. 3 shows an example of a structure of an array antenna according to an embodiment of the present disclosure.

Referring to FIG. 3, the array antenna according to the embodiment of the present disclosure may have a basic structure of a circular array antenna of a spiral shape in which a plurality of antenna elements are arranged on a plurality of concentric circles. The structure may minimize the intervals between the antenna elements in order to suppress grating lobes. Also, the structure may minimize the number of antenna elements that are arranged on a straight line corresponding to a radius from the center of the center concentric circle to the outermost concentric circle so that beam steering can be performed at various angles.

The array antenna according to the embodiment of the present disclosure may be designed as a structure satisfying the following conditions 1 to 4. The following conditions 1 to 4 may be necessarily satisfied in order to complete the structure of the array antenna according to the embodiment of the present disclosure. However, the conditions 1 to 4 do not have any ordered or sequential meaning.

- Condition 1: the total number n of concentric circles is decided such that the intervals between the concentric circles are within a range of 0.5 λ to 1 λ.
- Condition 2: an antenna element is necessarily positioned at the center of concentric circles.

Condition 3: the same number (an odd number) of antenna elements are arranged on each concentric circle.

Condition 4: an interval of rotation is applied to each of antenna elements arranged on each concentric circle.

Meanwhile, in the array antenna according to the embodiment of the present disclosure, a predetermined number N of antenna elements and a beam width required for communication have already been decided, and a structure of the array antenna according to the embodiment of the present disclosure may be decided based on the predetermined number N of antenna elements and the beam width in such a way to satisfy the conditions 1 to 4.

More specifically, according to an embodiment of the present disclosure, a radius of the outermost concentric circle capable of implementing the decided beam width may be decided according to the condition 1. Then, a total number of concentric circles may be decided such that the intervals between concentric circles included in the outermost concentric circle are within the range of 0.5 λ to 1 λ. At this time, the array antenna may be designed such that distances between the concentric circles have the same length.

Also, according to an embodiment of the present disclosure, an antenna element may be necessarily positioned at the center of the concentric circles, according to the condition 2.

Also, the number of antenna elements that are to be arranged on each concentric circle may be decided such that the same number of antenna elements are arranged on each concentric circle based on the predetermined number of antenna elements, according to the condition 3. At this time, the number of antenna elements that are to be arranged on each concentric circle may be decided as an odd number, and the number of antennal elements may be at least two. When the condition 2 is not satisfied (hereinafter, referred to as a "first case"), or when the additional generation of undesired lobes needs to be suppressed (hereinafter, referred to as a "second case"), the number of antenna elements that are arranged on each concentric circle may be adjusted under a sub condition that the total number of concentric circles is equal to or smaller than half the total number n of concentric circles decided according to the condition 1. In this case, if at least one antenna element needs to be added when the condition 2 is satisfied, an antenna element may be added starting from the innermost concentric circle of the entire concentric circles. On the contrary, if at least one antenna element needs to be removed when the condition 2 is satisfied, an antenna element may be removed starting from the outermost concentric circle of the entire concentric circles. The operation of adjusting the number of antenna elements is to add or remove a minimum number of antenna elements as long as the condition 1 is satisfied. The operation of adjusting the number of antenna elements will be described in detail, below.

Meanwhile, each of antenna elements arranged on each concentric circle according to the condition 4 may be positioned at the same angle θ with respect to the neighboring antenna elements arranged on the same concentric circle. In the array antenna according to the current embodiment, the concentric circles may have the same number of antenna elements, however, there may be exceptions. In consideration of the exceptions, a concentric circle (the innermost concentric circle if all of the concentric circles have the same number of antenna elements) in which the largest number of antenna elements are arranged may be decided as a reference concentric circle. Then, an interval of rotation may be calculated such that no antenna element exists, except for an antenna element arranged on the reference concentric circle, on a straight line corresponding to a radius of the outermost concentric circle. Then, antenna elements on the other concentric circles may be arranged at locations to which the interval of rotation is applied, so that no antenna element arranged on the other concentric circles exists on a straight line passing through the antenna element arranged on the reference concentric circle from the center of the concentric circles, the straight line corresponding to the radius.

Hereinafter, operations for the conditions 1 to 4 will be described in more detail.

In the current embodiment, when the total number of concentric circles is selected according to the condition 1, a beam width required for communication and the number of available antenna elements are most important. First, if a beam width is decided, the size of the array antenna may be decided. For example, if a beam width of 10° is required, the size of the circular array antenna may be decided such that the outermost concentric circle has a radius of about 3λ.

Figure 4A:
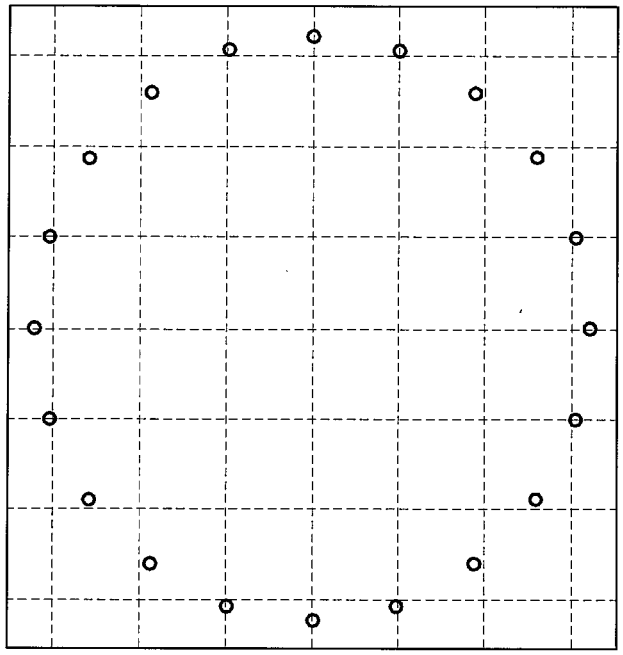
FIG. 4A shows an example of a circular array antenna configured with only an outermost concentric circle, according to an embodiment of the present disclosure.

FIG. 4A shows an example of a circular array antenna configured with only an outermost concentric circle, according to an embodiment of the present disclosure.

In FIG. 4A, the case in which a circular array antenna for implementing a beam width of 10° is configured with only an outermost concentric circle using 20 antenna elements is shown. In this case, the outermost concentric circle may have a radius of 3λ. The circular array antenna can remove grating lobes since the antenna elements are arranged on only the outermost concentric circle.

Figure 4B:
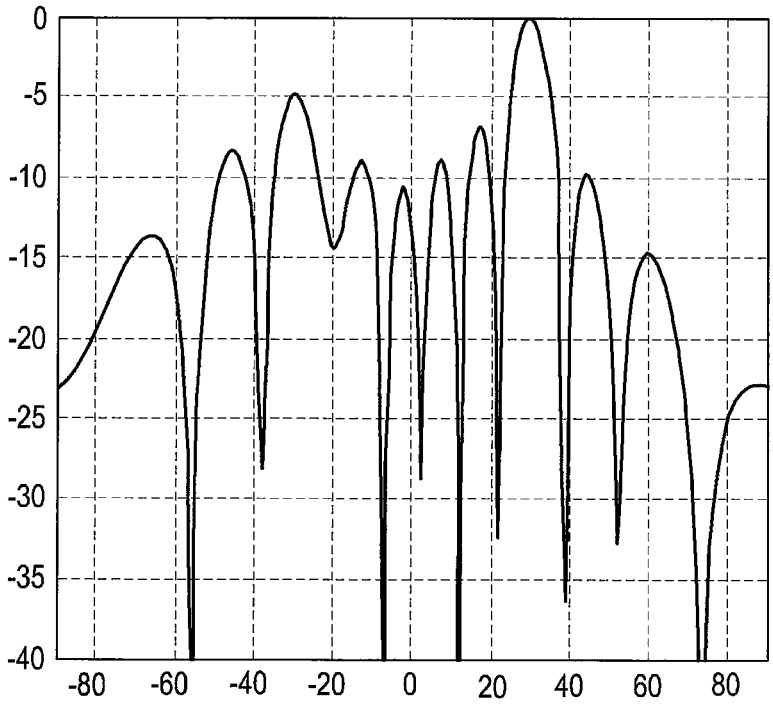
FIG. 4B shows an example of a beam pattern appearing when beam steering is performed with a predetermined angle on the circular array antenna of FIG. 4A.

FIG. 4B shows an example of a beam pattern appearing when beam steering is performed with a predetermined angle on the circular array antenna of FIG. 4A. Referring to FIG. 4B, since no antenna element exists in the inside of the outermost concentric circle in the circular array antenna of FIG. 4A, side lobes may increase.

Therefore, an array antenna according to an embodiment of the present disclosure may add a plurality of concentric circles in the inside of the outermost concentric circle, and arrange antenna elements such that a plurality of antenna elements are arranged at regular intervals on each concentric circle. The total number of concentric circles constituting the array antenna may be decided such that the interval between concentric circles that are to be added is within a range of 0.5λ to 1λ.

Figure 4C:
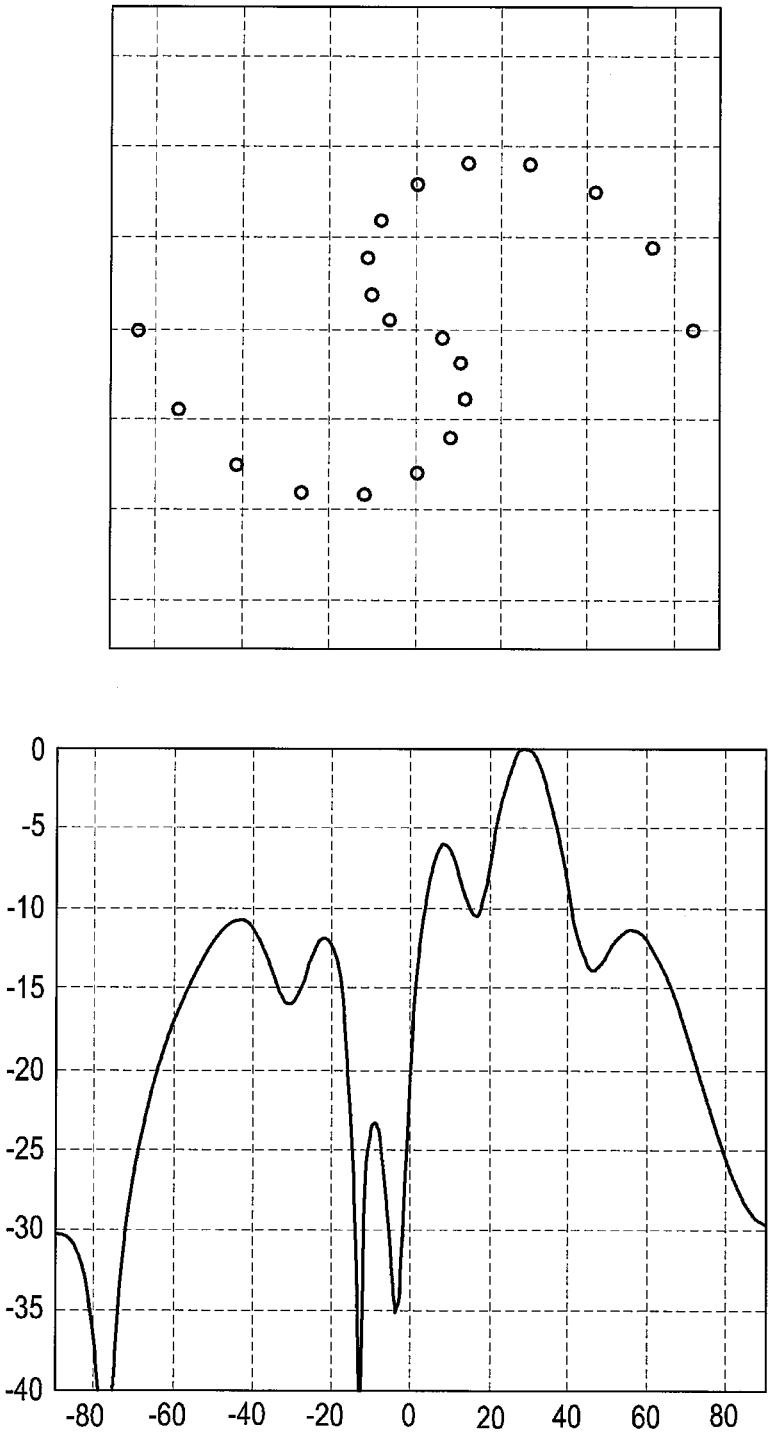
FIG. 4C shows an example of a problem generated when a plurality of concentric circles constituting a circular array antenna according to an embodiment of the present disclosure are arranged at intervals of 0.5 $\lambda$ or less.

FIG. 4C shows an example of a problem generated when a plurality of concentric circles constituting a circular array antenna according to an embodiment of the present disclosure are arranged at intervals of 0.5 λ or less.

Referring to FIG. 4C, if the interval between the concentric circles is 0.5 λ or less, a problem of mutual coupling may be caused between antenna elements arranged on the respective concentric circles since the concentric circles are too close to each other. Also, the number of antenna elements that are included in each concentric circle may become too small.

Figure 4D:
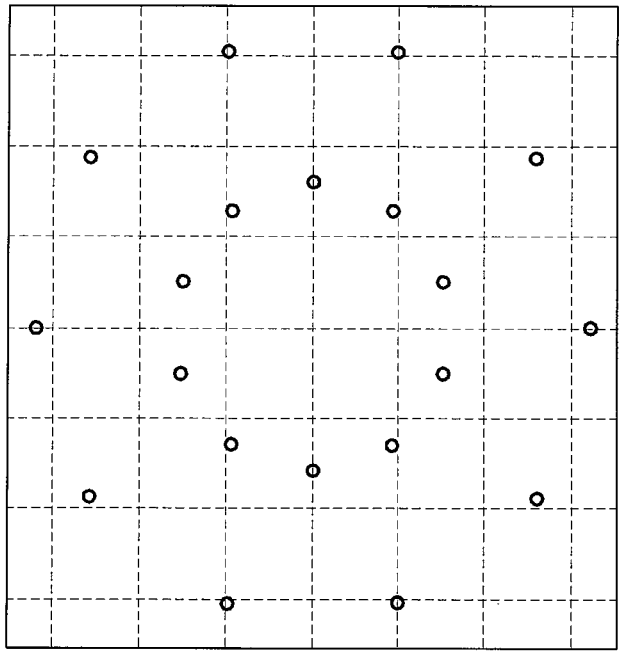
FIG. 4D shows an example of a problem generated when a plurality of concentric circles constituting a circular array antenna according to an embodiment of the present disclosure are arranged at intervals of 1.0 $\lambda$ or more.
Figure 4D:
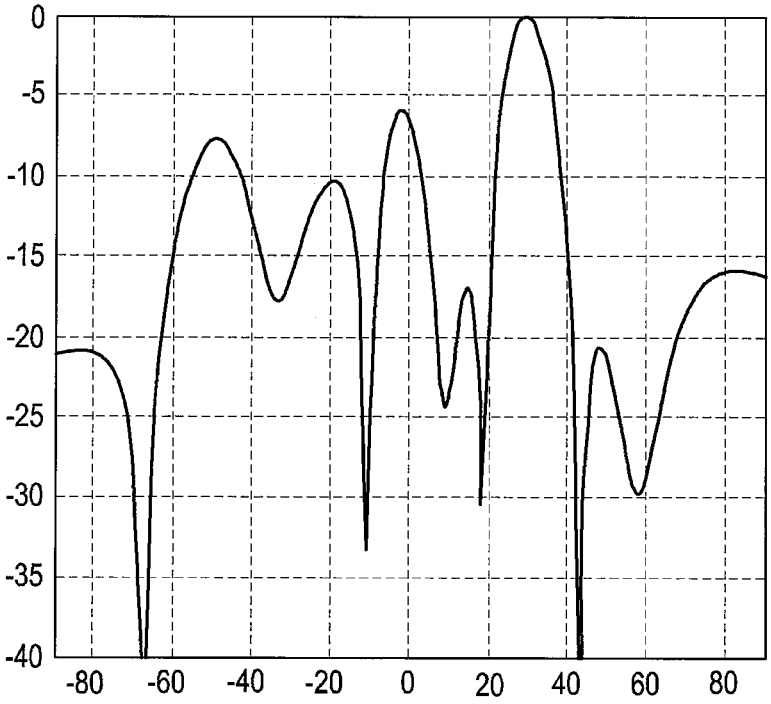

FIG. 4D shows an example of a problem generated when a plurality of concentric circles constituting a circular array antenna according to an embodiment of the present disclosure are arranged at intervals of 1λ or more.

Referring to FIG. 4D, if the interval between the concentric circles is 1λ or more, grating lobes may be generated since the concentric circles are too distant from each other. Therefore, the total number of concentric circles may be decided such that the interval between the concentric circles is within a range of 0.5λ to 1λ, based on the radius of the outermost concentric circle, according to the condition 1. For example, it is assumed that the radius of the circular array antenna is 3λ. If a plurality of concentric circles are arranged at intervals of 0.5λ to 1λ in the inside of an outermost concentric circle having a radius of 3λ, the total number of the concentric circles may be decided as 4 or 5. Then, the total number of concentric circles may be finally decided according to whether the condition 3 is satisfied.

Meanwhile, the concentric circles on which the antenna elements constituting the array antenna according to an embodiment of the present disclosure are arranged may be arranged at the same interval. The reason is because the intervals between the concentric circles influence the beam width of the array antenna. That is, as the concentric circles are arranged closer to the center of the concentric circles by reducing the intervals between the concentric circles, the beam width of the array antenna may increase. In contrast, as the concentric circles are arranged more distant from the center of the concentric circles by increasing the intervals between the concentric circles, the beam width of the array antenna may decrease.

Figure 5A:
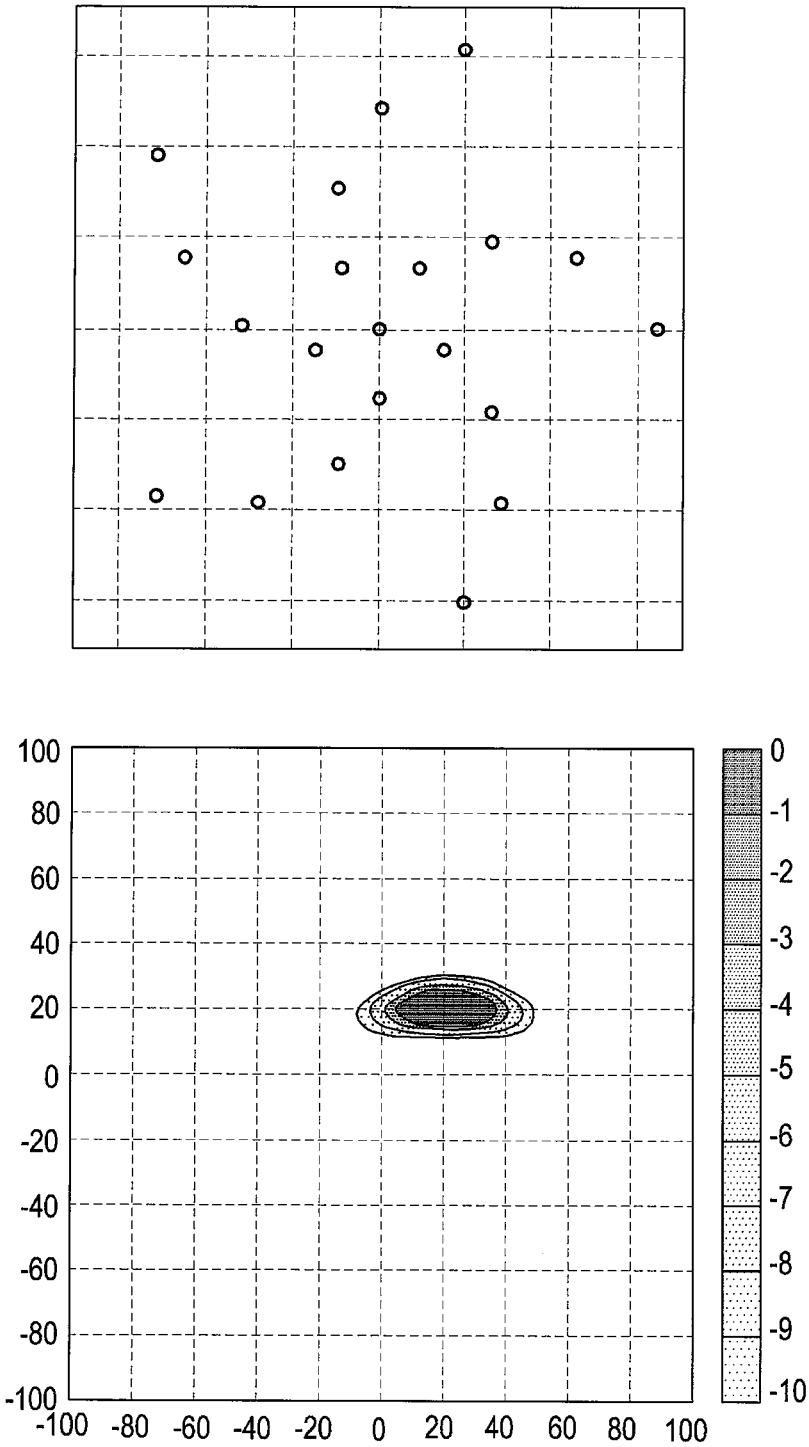
FIGS. 5A and 5B show examples of changes of beam patterns according to the intervals between concentric circles according to embodiments of the present disclosure.
Figure 5B:
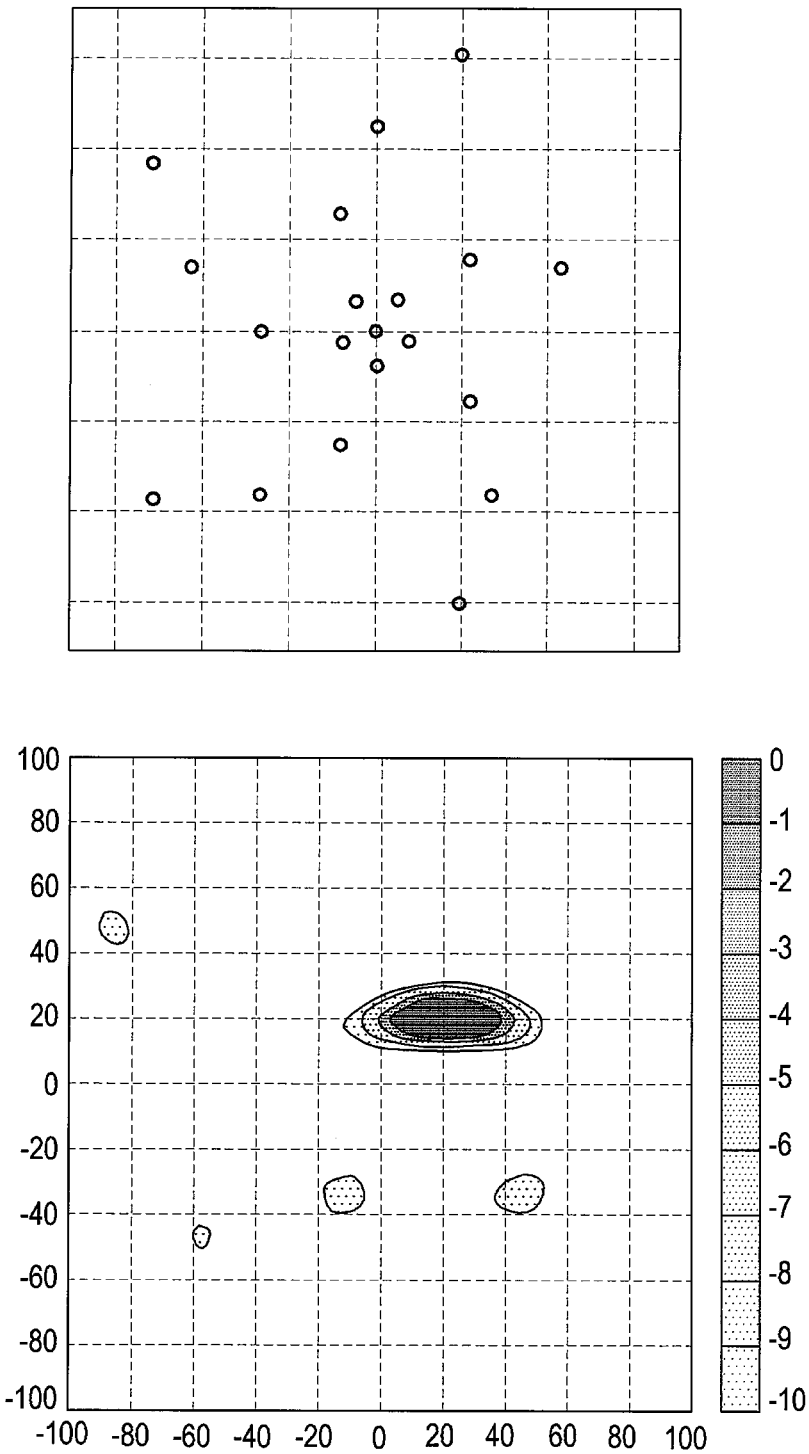

FIGS. 5A and 5B show examples of changes of beam patterns according to intervals between concentric circles according to embodiments of the present disclosure.

Referring to FIG. 5A, it is seen that when the concentric circles are arranged at the same interval, grating lobes little appear. However, it is seen that if the concentric circles are arranged at different intervals by changing the radius of each concentric circle, undesired lobes are generated since the changed concentric circle becomes distant from another concentric circle existing in the inside, as shown in FIG. 5B. Also, when a plurality of antenna elements exist on a straight line crossing the concentric circles, undesired lobes may be generated according to an angle of beam steering. Therefore, in an array antenna according to an embodiment of the present disclosure, concentric circles may be arranged at the same interval, as shown in FIG. 5A.

Figure 6A:
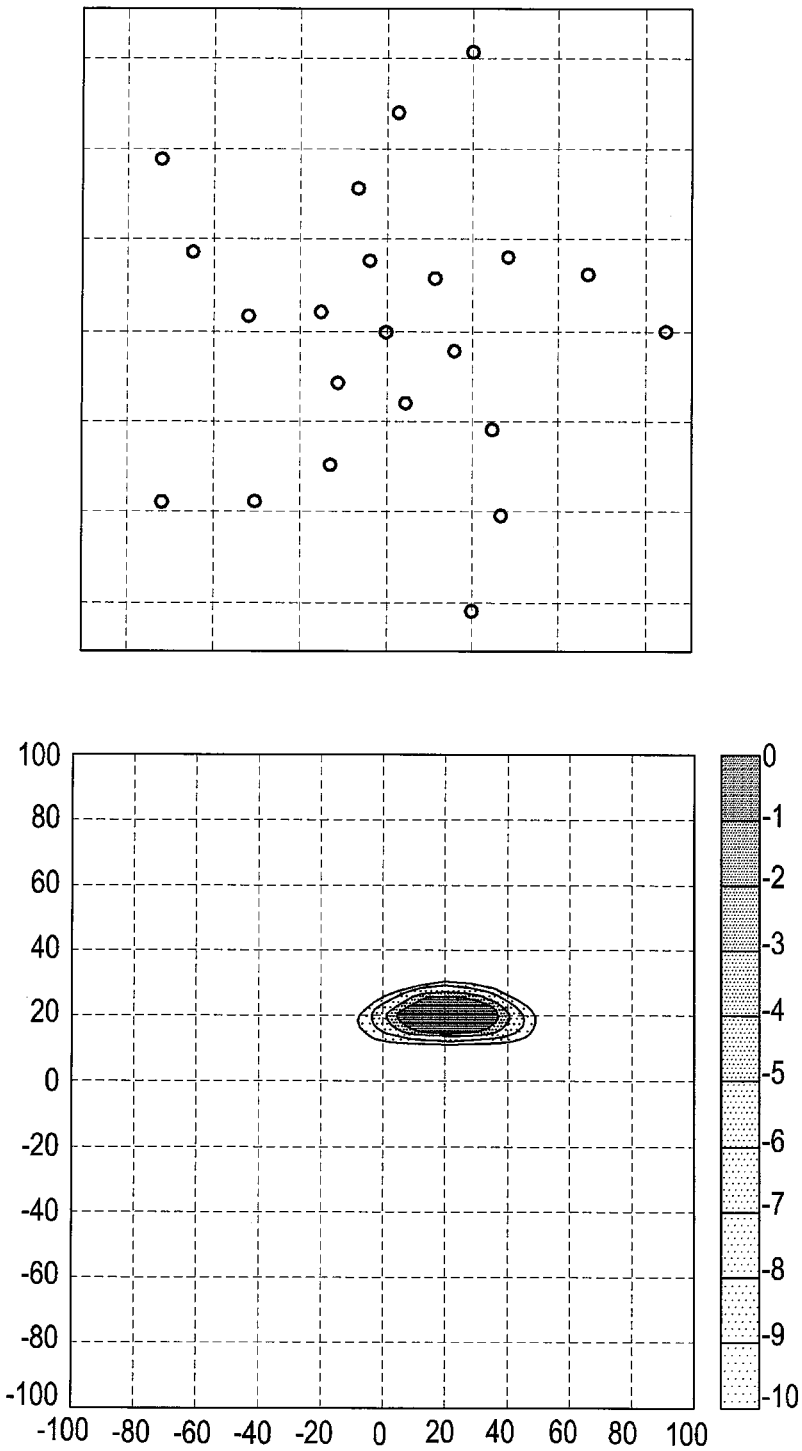
FIGS. 6A and 6B show changes of beam patterns according to whether or not an antenna element is positioned at the center of concentric circles, in a circular array antenna according to an embodiment of the present disclosure.
Figure 6B:
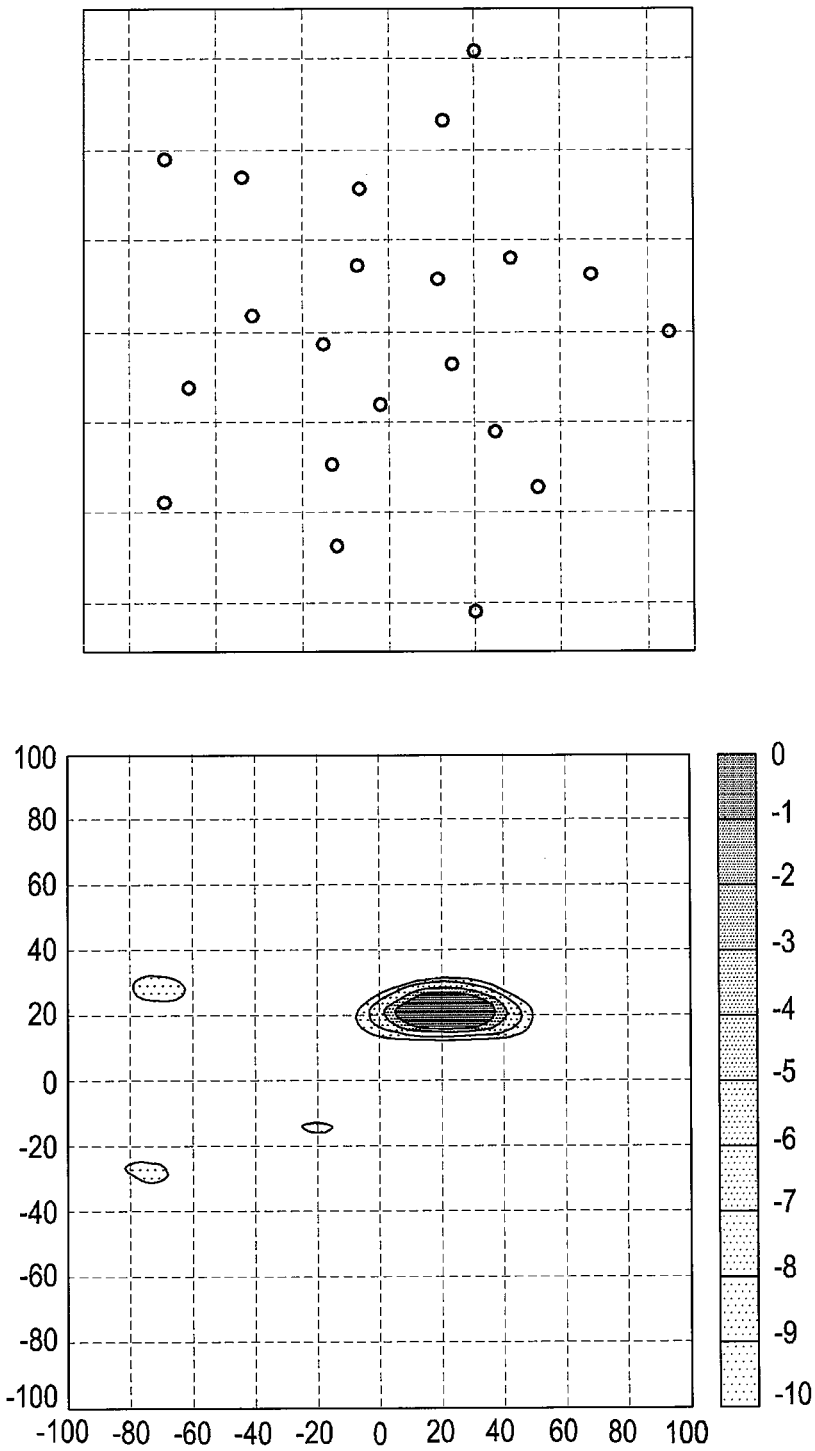

FIGS. 6A and 6B show changes of beam patterns according to whether or not an antenna element is positioned at the center of concentric circles, in a circular array antenna according to an embodiment of the present disclosure.

FIG. 6A shows the case in which an antenna element is positioned at the center of the concentric circles. Referring to FIG. 6A, when an antenna element is positioned at the center of the concentric circles, the intervals between the antenna elements may be reduced, and the number of antenna elements arranged in the inside of the array antenna may increase. Accordingly, in this case, neither grating lobes nor side lobes may be generated, compared to the case of FIG. 6B in which no antenna element is disposed at the center of the concentric circles. Therefore, in the circular array antenna according to the current embodiment, an antenna element may be necessarily positioned at the center of the concentric circles, according to the condition 2.

Figure 7A:
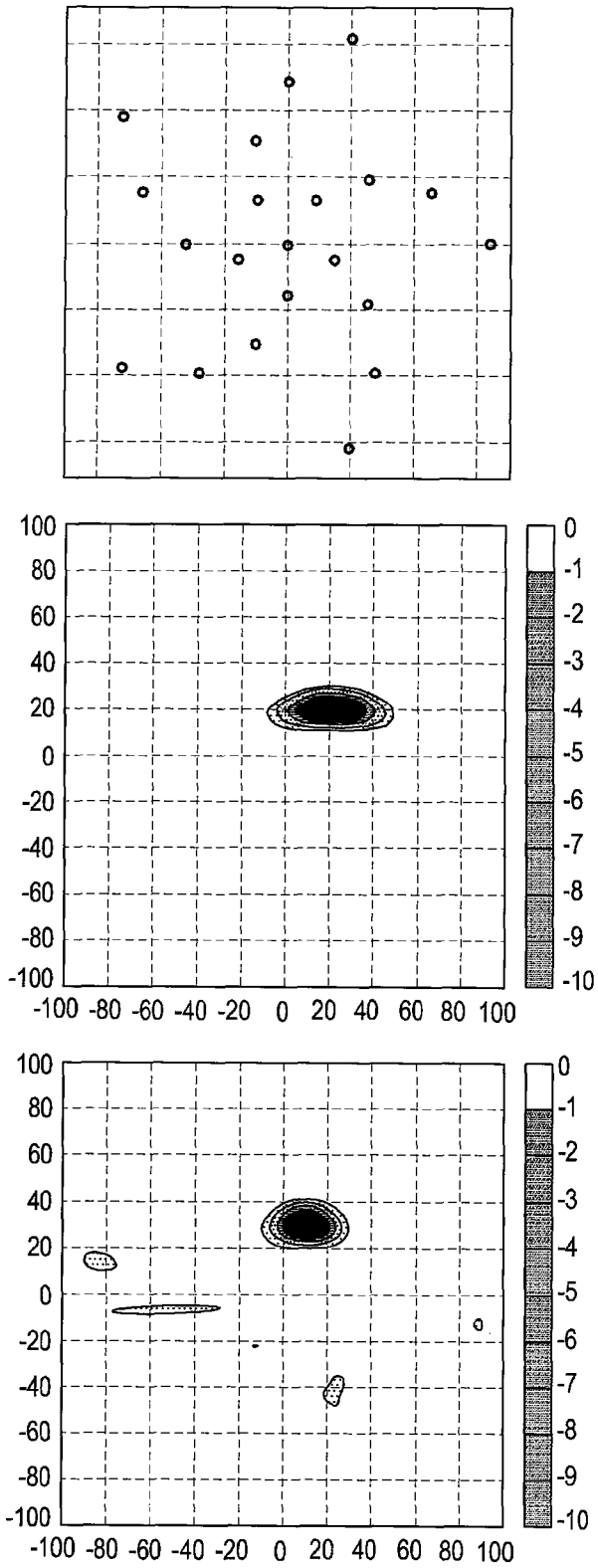
FIGS. 7A and 7B show beam patterns according to the angles of beam steering when different numbers of antenna elements are arranged on concentric circles, in a circular array antenna according to an embodiment of the present disclosure.
Figure 7B:
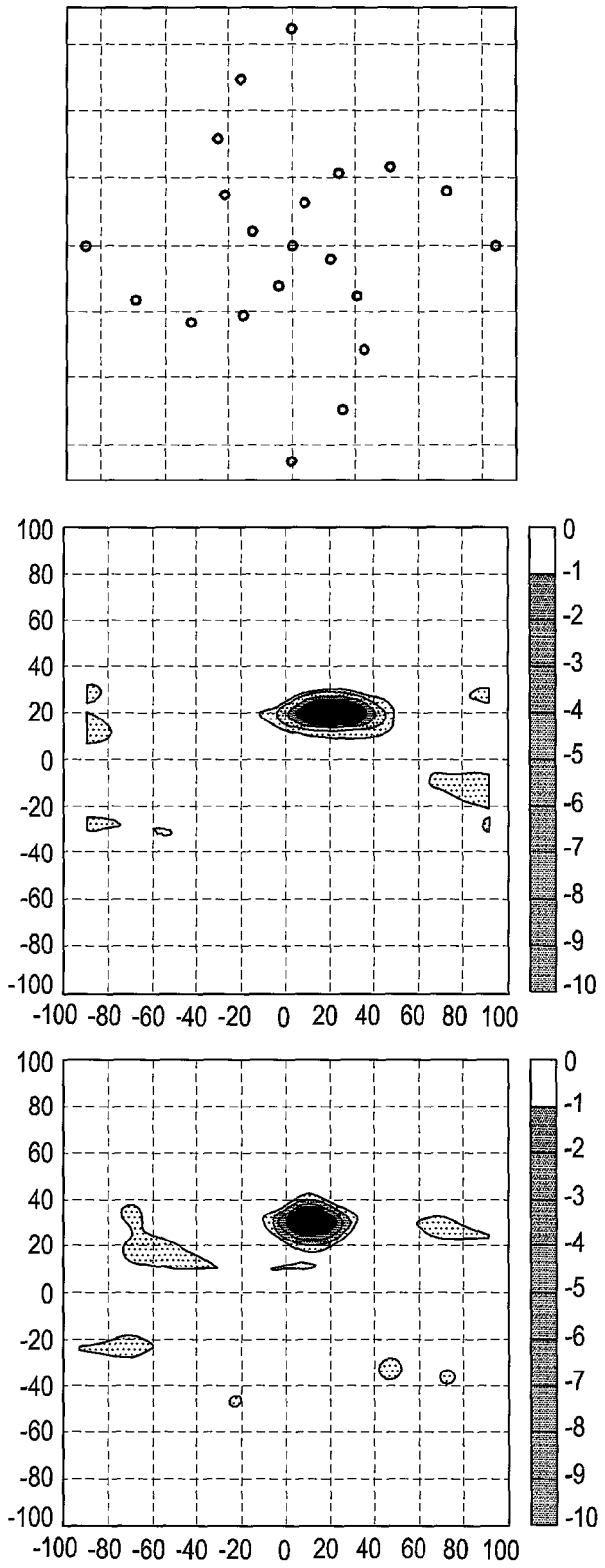

FIGS. 7A and 7B show beam patterns according to angles of beam steering when different numbers of antenna elements are arranged on concentric circles, in a circular array antenna according to an embodiment of the present disclosure. For example, it is assumed that the total number of antenna elements is 21, and the radius of the outermost concentric circle is 3λ in order to implement a beam width of 10°. In this case, the total number of concentric circles constituting the circular array antenna may be decided as 4 or 5. The second graphs of FIGS. 7A and 7B relate to the case in which angles of beam steering are $\theta=20°$ and $\Phi=20°$, and the third graphs of FIGS. 7A and 7B relate to the case in which angles of beam steering are $\theta=30°$ and $\Phi=10°$.

More specifically, in FIG. 7A, the case in which 4 concentric circles are applied, and 5 antenna elements are arranged on each concentric circle is shown. In contrast, in FIG. 7B, the case in which 5 concentric circles are applied, and 4 antenna elements are arranged on each concentric circle is shown. As a result, referring to the second graph of FIG. 7A in which an odd number of antenna elements are arranged on each concentric circle, undesired lobes are little generated. Also, referring to the third graph of FIG. 7A in which an odd number of antenna elements are arranged on each concentric circle, a relatively small amount of undesired lobes are generated although beam steering is performed, compared to the case of FIG. 7B in which an even number of antenna elements are arranged on each concentric circle. Therefore, the circular array antenna according to the current embodiment may be configured to satisfy the condition 3 that the number of antenna elements arranged on each concentric circle is an odd number. Also, the circular array antenna may be configured such that at least two antenna elements are arranged on each concentric circle. If the number of antenna elements that can be arranged on each concentric circle is an even number, there may be generated the case in which at least three antenna elements are arranged on a straight line crossing the concentric circles from the center of the concentric circles.

Meanwhile, the case in which the condition that at least two antenna elements should be arranged on each concentric circle is not satisfied, for example, the case in which 27 antenna elements are arranged on 4 or 5 concentric circles in the inside of the outermost concentric circle having a radius of 3λ is assumed. Also, it is assumed that 26 antenna elements except for an antenna element positioned at the center of the concentric circles are arranged such that the same odd number of antenna elements are arranged on each concentric circle. In this case, if 4 concentric circles are used, 7 antenna elements can be arranged on each concentric circle, and accordingly, two antenna elements may need to be removed. Meanwhile, if 5 concentric circles are used, 5 antenna elements may be arranged on each concentric circle, and one antenna element may need to be added on one of the 5 concentric circles.

Figure 8A:
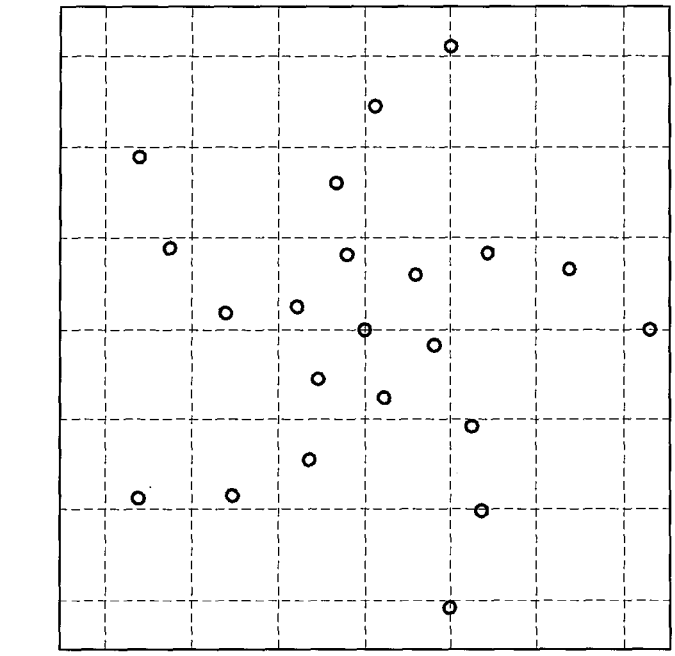
FIGS. 8A and 8B show examples of changes of beam patterns according to the positions of concentric circles, when arbitrary antenna elements are added, in a circular array antenna according to an embodiment of the present disclosure.
Figure 8A:
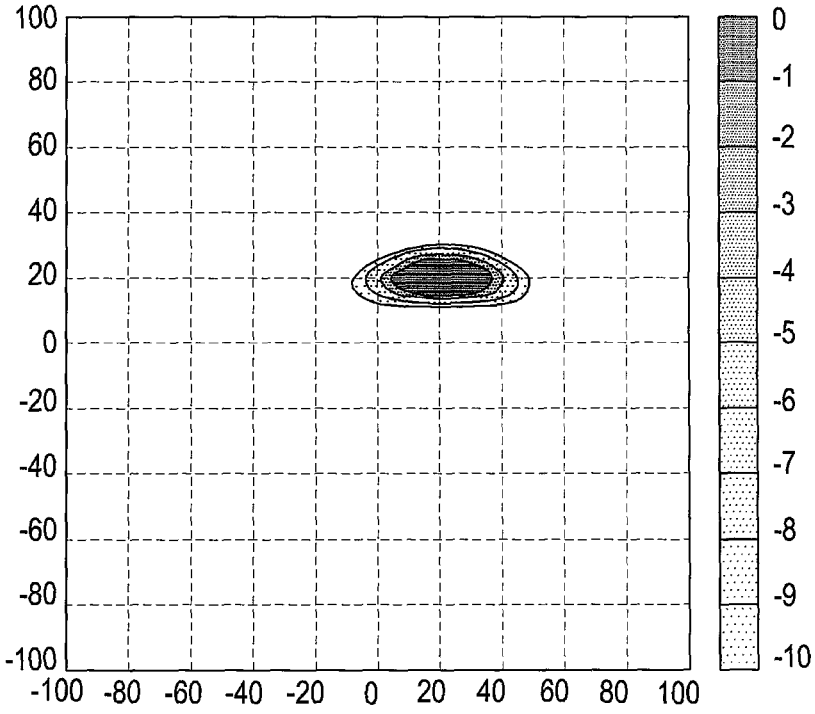
Figure 8B:
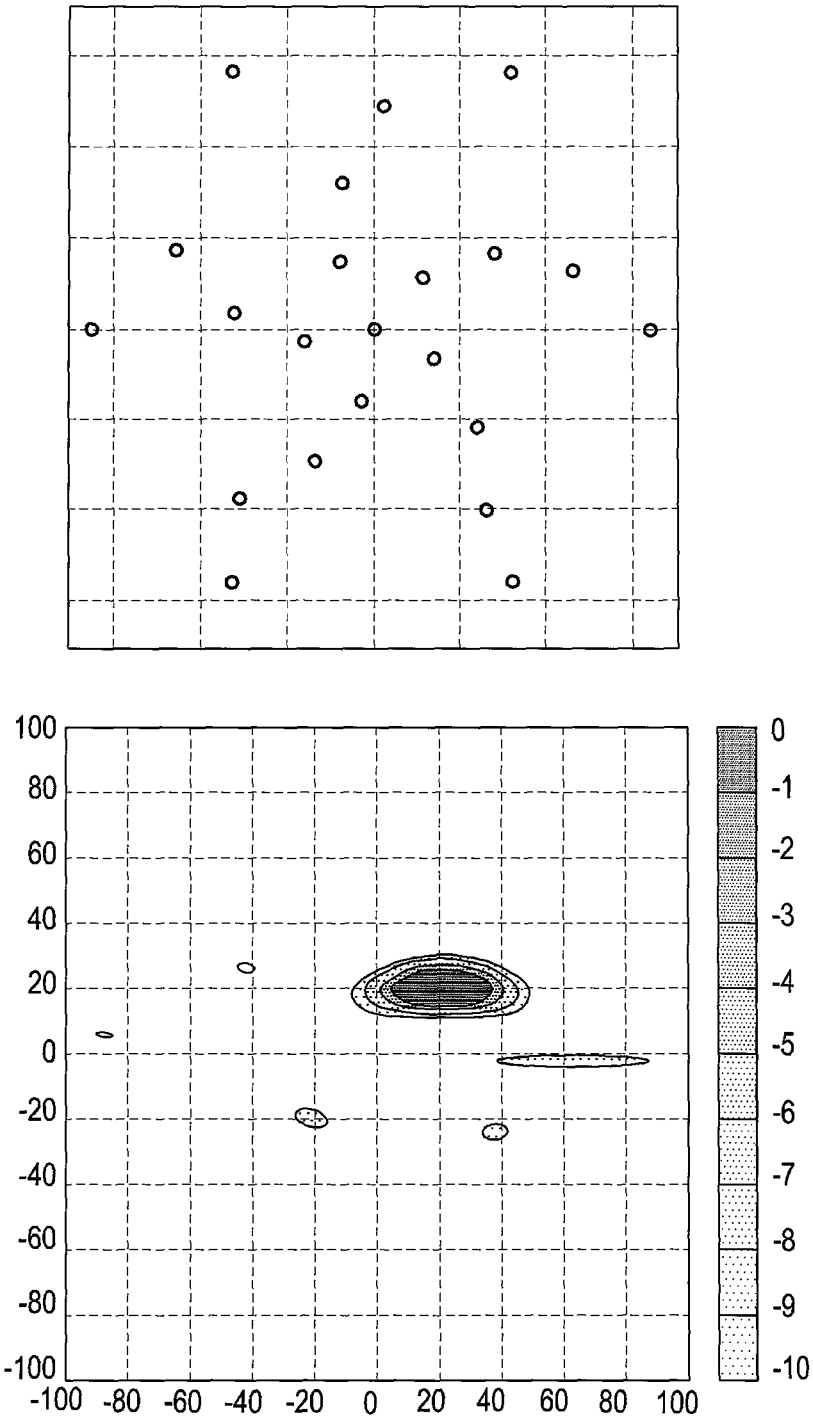

FIGS. 8A and 8B show examples of changes of beam patterns according to the positions of concentric circles when arbitrary antenna elements are added, in a circular array antenna according to an embodiment of the present disclosure. FIG. 8A shows the case in which an antenna element is added on a concentric circle closest to the center of concentric circles. In contrast, FIG. 8B shows the case in which an antenna element is added on the outermost concentric circle. In the case of FIG. 8B, it is seen that a relatively large amount of grating lobes and side lobes are generated rather than the case of FIG. 8A. Therefore, in the circular array antenna according to the current embodiment, when an antenna element needs to be added, the antenna element may be added on a concentric circle closest to the center of concentric circles. Likewise, when one of antenna elements arranged on the circular array antenna needs to be removed, one of antenna elements arranged on the outermost concentric circle may be removed. In order to prevent side lobes from being additionally generated based on the above-described principle, an antenna element arranged on a concentric circle located distant from the center of concentric circles may be moved to any one of concentric circles located close to the center of the concentric circles. However, in this case, since the spiral structure of the array antenna becomes incomplete, grating lobes may be generated according to an angle of beam steering.

In the circular array antenna according to the current embodiment, a predetermined number of antenna elements may be arranged on each of concentric circles, according to the conditions 1 to 3 as described above. Also, in the current embodiment, an interval of rotation may be applied such that a plurality of antenna elements are not arranged on a straight line crossing the concentric circles from the center of the concentric circles.

Figure 9A:
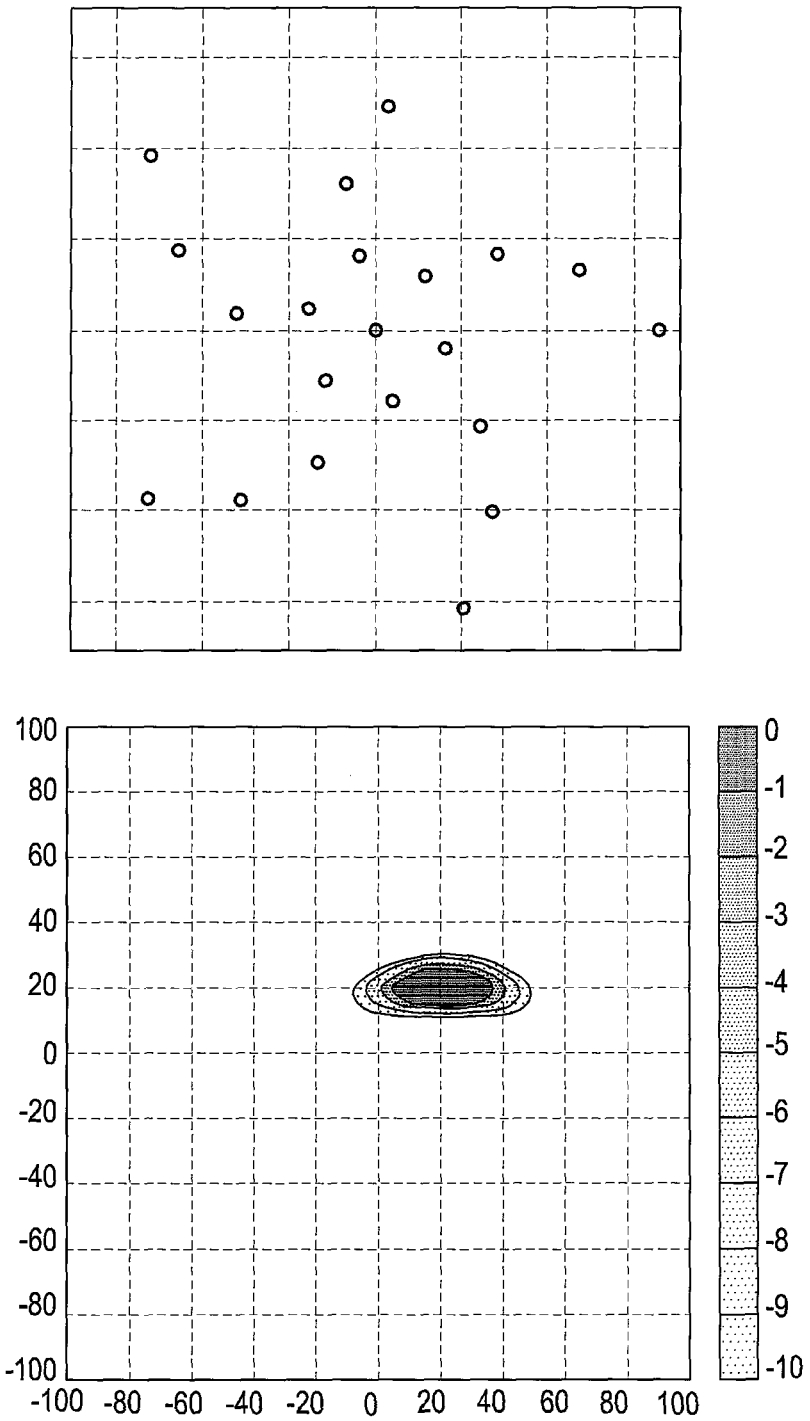
FIGS. 9A and 9B show examples of beam patterns according to whether or not antenna elements are arranged in a spiral shape on concentric circles constituting a circular array antenna according to an embodiment of the present disclosure.
Figure 9B:
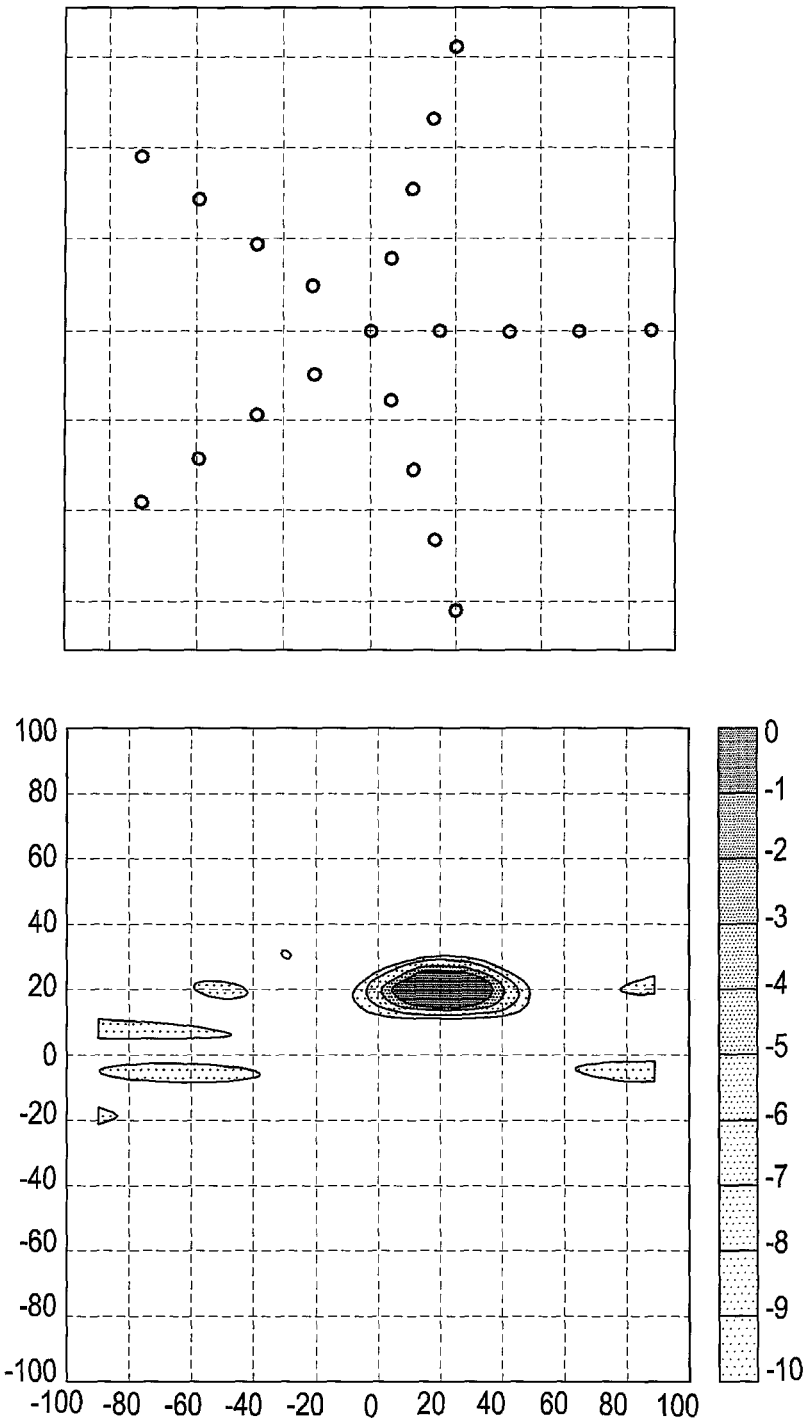

FIGS. 9A and 9B show examples of beam patterns according to whether or not antenna elements are arranged in a spiral shape on concentric circles constituting a circular array antenna according to an embodiment of the present disclosure.

In FIG. 9A, the case in which an interval of rotation is applied such that each of antenna elements arranged on each of concentric circles constituting the circular array antenna does not share a straight line crossing the concentric circles from the center of the concentric circles, with other antenna elements, according to the condition 4, is shown. In this case, it is seen that undesired lobes are little generated. In contrast, in FIG. 9B, the case in which antenna elements arranged on concentric circles form several straight lines extending outward from the center of the concentric circles since no interval of rotation is applied is shown. As a result, the circular array antenna of FIG. 9B generates a significantly large amount of undesired lobes, compared to the circular array antenna of FIG. 9A to which the interval of rotation is applied. Accordingly, according to an embodiment of the present disclosure, the circular array antenna may be configured by applying the interval of rotation to each of the antenna elements arranged on the concentric circles.

First, a concentric circle on which a maximum number of antenna elements are to be arranged may be selected from among the concentric circles. If the same number of antenna elements are arranged on each concentric circle, according to the condition 3, a concentric circle located closest to the center of the concentric circles may be decided as a reference concentric circle C1. Then, by dividing the total angle 360° of each concentric circle by the number of antenna elements that are to be arranged on the reference concentric circle C1, an interval between the antenna elements that are to be arranged on the reference concentric circle C1 may be calculated. For example, referring to FIG. 3, since the number of antenna elements that are to be arranged on the reference concentric circle C1 is 7, the interval between the antenna elements that are to be arranged on the reference concentric circle C1 may be calculated as "360/7 (θ)". Then, the antenna elements may be arranged at the calculated interval on the reference concentric circle C1. Thereafter, by dividing the calculate value θ by the total number n of concentric circles, an interval of rotation θ/n according to an embodiment of the present disclosure may be calculated. After the interval of rotation θ/n is calculated, antenna elements that are to be arranged on the next concentric circle may be arranged by increasing or decreasing the angles of the antenna elements on the next concentric circle by the interval of rotation with respect to the angles of the antenna elements arranged on the reference concentric circle C1. In the same way, antenna elements that are to be arranged on the following concentric circles may also be arranged by increasing or decreasing the angles of the antenna elements by the interval of rotation with respect to the angles of antenna elements arranged on the previous concentric circles. At this time, the interval of rotation may be applied to all the concentric circles in such a way that the angles of antenna elements on the concentric circles all increase or decrease. If the antenna elements are completely arranged for each concentric circle as described above, the circular array antenna according to the current embodiment may be configured so that the antenna elements arranged on the concentric circles do not overlap each other on a straight line crossing the concentric circles from the center of the concentric circles.

FIGS. 10A to 10D show changes of beam patterns according to various angles of beam steering of a circular array antenna according to an embodiment of the present disclosure.

Figure 10A:
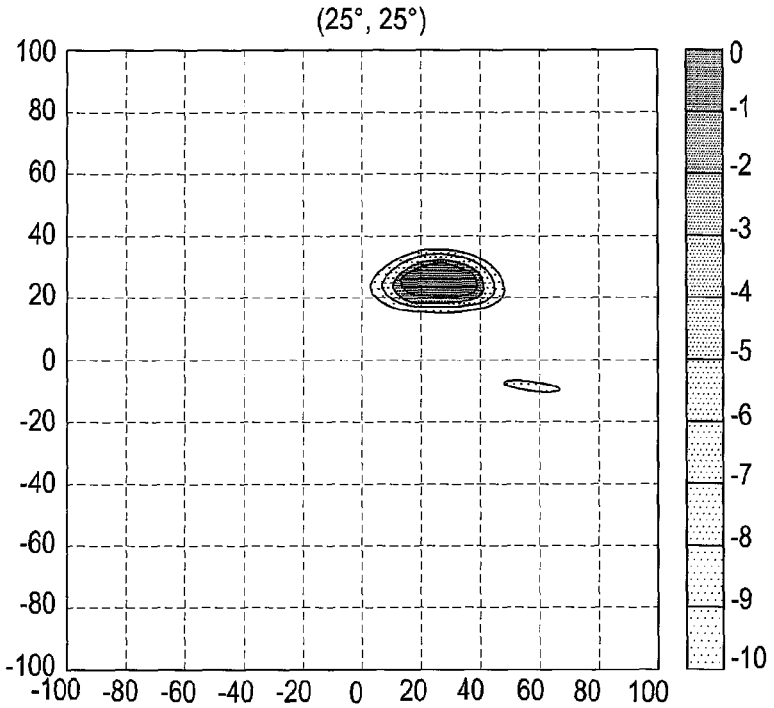
FIGS. 10A to 10D show changes of beam patterns according to various angles of beam steering of a circular array antenna according to an embodiment of the present disclosure.
Figure 10B:
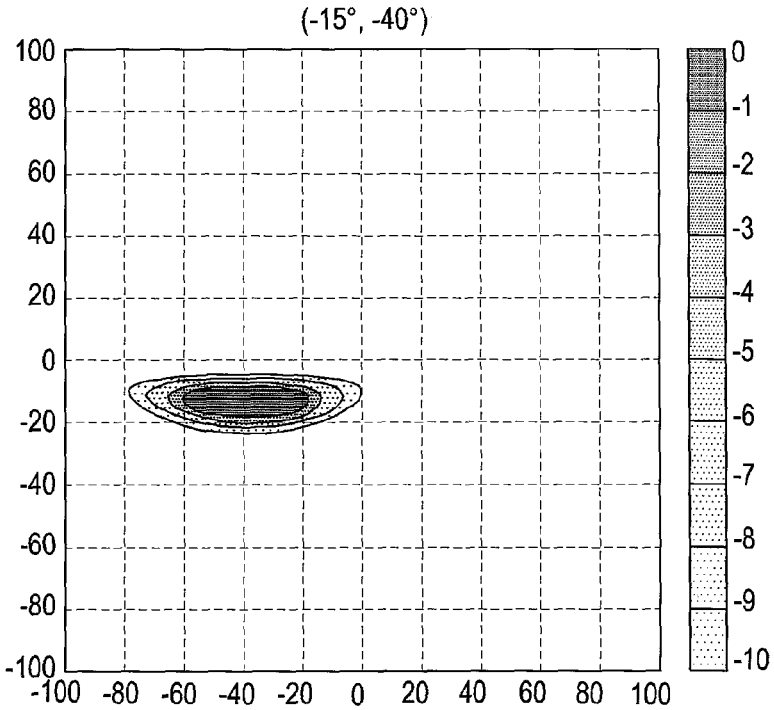
Figure 10C:
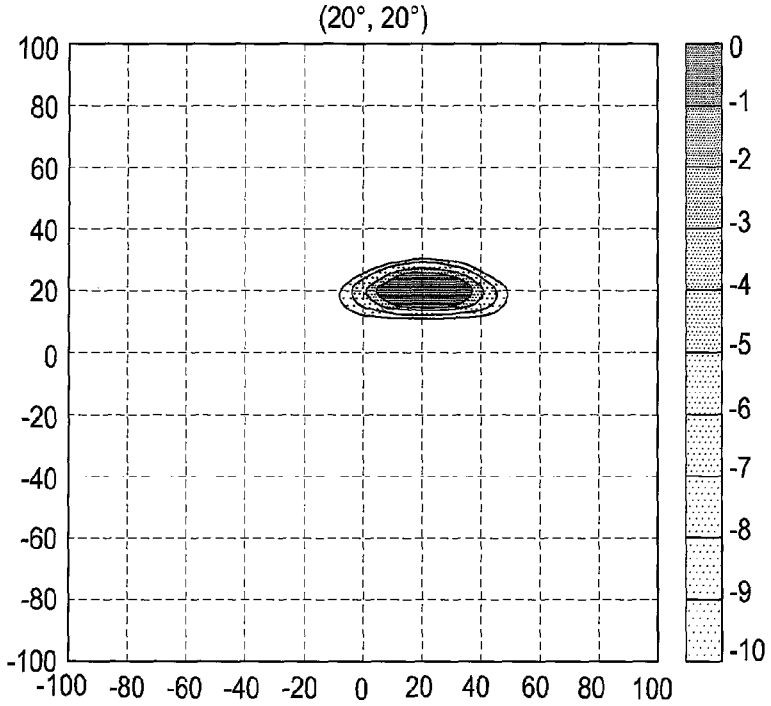
Figure 10D:
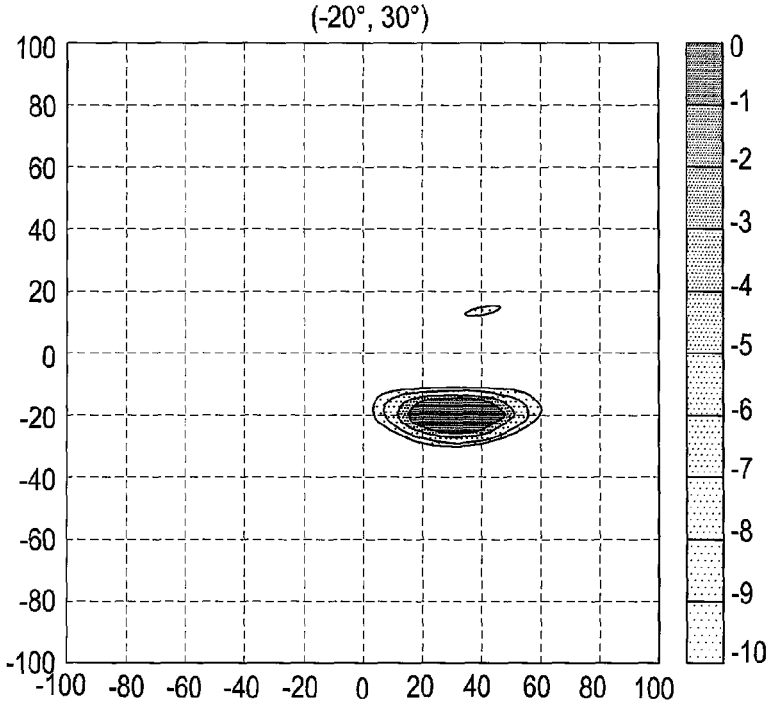

FIG. 10A relates to the case in which angles of beam steering applied to the circular array antenna according to the embodiment of the present disclosure are θ=20° and Φ=20°, and FIG. 10B relates to the case in which angles of beam steering applied to the circular array antenna according to the embodiment of the present disclosure are θ=−15° and Φ=−40°. Also, FIG. 10C relates to the case in which angles of beam steering applied to the circular array antenna according to the embodiment of the present disclosure are θ=20° and Φ=20°, and FIG. 10B relates to the case in which angles of beam steering applied to the circular array antenna according to the embodiment of the present disclosure are θ=−20° and Φ=30°. Referring to FIGS. 10A to 10D, it is seen that in the circular array antenna according to the embodiment of the present disclosure, unexpected grating lobes and side lobes are little generated although beam steering is performed at various angles. That is, the circular array antenna according to the embodiment of the present disclosure can suppress the generation of undesired lobes while implementing a predetermined beam width using a predetermined number of antenna elements. As a result, the circular array antenna according to the embodiment of the present disclosure can minimize the generation of undesired lobes while satisfying a limited beam width in a BDMA-based environment, thereby minimizing interference between beams upon multiple-access. Further, the circular array antenna according to the embodiment of the present disclosure may require a smaller number of antenna elements than a general array antenna of implementing the same beam width to reduce the number of RF chains, thereby reducing manufacturing costs.

Also, the circular array antenna according to the embodiment of the present disclosure can satisfy restriction conditions, such as the number of antenna elements or a beam width, while minimizing the generation of undesired lobes even in an environment to which a general array antenna is applied, as well as in the BDMA-based environment. In addition, the circular array antenna can also reduce undesired lobes increasing upon beam steering. Finally, a circular array antenna that satisfies one(s) of the restriction conditions described above can be manufactured to increase a degree of freedom.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

The invention claimed is:

1. An array antenna apparatus comprising:

a first antenna element positioned at a center of an outermost concentric circle having a radius that is decided according to a beam width of a beam to be transmitted; and a plurality of antenna element sets respectively arranged on circumferences of a plurality of concentric circles arranged at a predetermined interval in an inside of the outermost concentric circle, wherein each of the antenna element sets consists of an odd number of second antenna elements, and wherein an antenna element exists on a straight line corresponding to the radius.

2. The array antenna apparatus of claim 1, wherein the concentric circles are arranged at a same interval.

3. The array antenna apparatus of claim 1, wherein the predetermined interval is within a range of 0.5λ to 1λ.

4. The array antenna apparatus of claim 1, wherein the antenna element sets include a same number of the second antenna elements.

5. The array antenna apparatus of claim 1, wherein if the antenna element sets do not include a same number of the second antenna elements, a number of the second antenna elements arranged on a concentric circle located closest to the center is greater by 1 than a number of the second antenna elements arranged on each of remaining concentric circles.

6. The array antenna apparatus of claim 1, wherein if the antenna element sets do not include a same number of the second antenna elements, a number of the second antenna elements arranged on the outermost concentric circle is smaller by 1 than a number of the second antenna elements arranged on each of remaining concentric circles.

7. The array antenna apparatus of claim 1, wherein if the antenna element sets include a same number of the second antenna elements, the second antenna elements arranged on each of the concentric circles are respectively arranged with an interval of rotation with respect to the second antenna elements arranged on a neighboring concentric circle, and the interval of rotation corresponds to a value resulting from dividing an interval between the second antenna elements arranged on the concentric circle located closest to the center by a total number of the concentric circles.

8. The array antenna apparatus of claim 7, wherein the interval between the second antenna elements corresponds to an angle resulting from dividing 360 degrees by a number of the second antenna elements that are to be arranged on the concentric circle located closest to the center.

9. The array antenna apparatus of claim 1, wherein numbers of the second antenna elements respectively arranged on circumferences of the plurality of concentric circles are same as each other.

* * * * *